United States Patent [19]

Dobner et al.

[11] Patent Number: 5,027,730

[45] Date of Patent: Jul. 2, 1991

[54] SEWING MACHINE WITH A THREAD MONITOR FOR THE THREAD OF THE BOBBIN

[75] Inventors: Reinhold Dobner; Bernhard Mertel; Erich Willenbacher, all of Kaiserslautern, Fed. Rep. of Germany

[73] Assignee: Pfaff Industriemaschinen GmbH, Fed. Rep. of Germany

[21] Appl. No.: 415,339

[22] PCT Filed: Dec. 3, 1987

[86] PCT No.: PCT/EP87/00754

§ 371 Date: Nov. 1, 1989

§ 102(e) Date: Nov. 1, 1989

[87] PCT Pub. No.: WO88/07099

PCT Pub. Date: Sep. 22, 1988

[30] Foreign Application Priority Data

Mar. 7, 1987 [DE] Fed. Rep. of Germany ..... 3707321

[51] Int. Cl.[5] ..... D05B 69/36

[52] U.S. Cl. ..... 112/278; 242/37 R

[58] Field of Search ..... 112/273, 278, 80.18; 242/37 R; 250/561

[56] References Cited

U.S. PATENT DOCUMENTS 4,558,654 12/1985 Schilling ..... 112/273 X
4,569,298 2/1986 Lindh et al. ..... 112/278
4,805,544 2/1989 Dobner et al. ..... 112/273 X

FOREIGN PATENT DOCUMENTS 1203584 5/1966 Fed. Rep. of Germany .
2451533 5/1976 Fed. Rep. of Germany .

*Primary Examiner*—Peter Nerbun
*Attorney, Agent, or Firm*—McGlew & Tuttle

[57] ABSTRACT

Thread monitor for monitoring double lock stitch shuttles or hooks and chain stitch machine shuttles or loopers. During normal operation of the sewing machine, the shuttle thread is used as a reflection surface. The scattered light beams reflected by the thread enter photodetector 10 of the thread monitor 8. If the support surface 7, 28 is covered by thread, light beams will reach said photodetector 10, as a result of which a control circuit 12 connected to it issues a warning signal.

14 Claims, 3 Drawing Sheets

VIII
VIII
S
R
Q
1

SEWING MACHINE WITH A THREAD MONITOR FOR THE THREAD OF THE BOBBIN

The invention relates, in general, to sewing devices and in particular to a new and useful sewing machine having a device associated with the machine shuttle which indicates the presence of the sewing thread.

A thread monitor for the opto-electronic monitoring of the thread of the bobbin is known from the U.S. Pat. No. 4,163,158. The thread monitor has a light source and a light detector, which are disposed radially to the shuttle axis. The light rays pass through an opening into the interior of the shuttle. If the bobbin is filled below a certain level, the light rays are reflected at reflection surfaces at the bobbin hub, then exit from the shuttle and reach the light detector. As soon as the light detector receives these light rays, a warning signal is emitted to announce the end of the thread.

With such thread monitors, the danger exists that light rays are reflected either from thread windings or from at least partially exposed reflection surfaces of the bobbin hub. The light rays reflected at the thread windings act like a false signal at the light detector and distort the signal formed from the reflected light rays.

Another opto-electronic thread monitor is known from the German Offenlegungsschrift 2,451,533. This monitor is used to monitor a single thread, which runs horizontally or vertically. A portion of the light rays incident on the thread is reflected in the direction of the light detector. As soon as a thread no longer contacts the monitoring point, for example, because of a thread breakage, light rays no longer reach the light detector. Thereupon a control circuit associated with the light detector emits a warning signal.

With threads that are not centered at the monitoring point, sagging due to gravity cannot be excluded in case of horizontal guidance, and unintended lateral deflection due to vibrations cannot be excluded in case of vertical guidance. Thus, the light rays coming from the light source can miss the thread, so that no reflected light rays reach the light detector. As a consequence, a warning signal is emitted even though there is no malfunction with respect to the thread. The known thread monitor thus operates relatively unreliably and is therefore unsuitable for indicating the end of the thread or a breakage of the thread in shuttles.

A thread monitor for the electro-mechanical monitoring of a single winding of the thread on the bobbin is known from the German Patent 1,203,584. The thread is conducted in a groove on the outside of the bobbin case along its periphery. It is sensed by a spring-loaded contact flap that is electrically connected to a bobbin case support. When the end of the thread has passed the contact flap, the flap touches the bobbin case, thus establishing the electrical connection between the contact flap and the bobbin case. As soon as a bobbin case-opening lever, which operates in pulse-like fashion and is connected to an electrical power source, strikes against a contact protrusion of the bobbin case, the circuit is closed and the sewing machine is stopped. With a thread monitor of this design, the thread is sensed through the action of frictional forces, so that wear of the thread and of parts of the shuttle, and of the thread monitor, cannot be excluded.

SUMMARY OF THE INVENTION

The invention provides a shuttle for a sewing machine with a thread monitor, which is non-contacting but at the very least wear-free, in such a fashion that the monitor responds only when a malfunction, such as the end of thread or a thread breakage, actually occurs at the thread.

With this arrangement, it is possible to perceive the scattered light rays that have been reflected by a single thread winding. For example, as long as the thread winding covers the support surface, the light detector receives the small portion of the scattered light rays that has been reflected in its direction. These scattered light rays form a relatively weak signal in the light detector. This weak signal can then be amplified in the control circuit to such an extent that it can be used as proof that the thread has been drawn off without any malfunction. On the other hand, as soon as the support surface is not covered by the thread, light rays are prevented from reaching the light detector. As soon as there is no signal at the control circuit, the circuit emits a warning signal to indicate the end of the thread or a breakage of the thread.

The invention includes different ways to prevent the light rays, which strike the support surface directly, from reaching the light detector.

All the light rays incident at both sides of the thread are advantageously reflected so that they do not reach the light detector as a false signal.

There is a possibility with the invention, according to which even one thread winding can be sensed to provide the advantage that the thread can be sensed at an easily monitored point of the shuttle. An annular wall of the bobbin case is a fixed part of a double lock stitch shuttle, and can be made easily accessible to the light rays.

An embodiment of the invention is such that it causes the thread to slide over the support surface without interference.

The inventive arrangement is preferably suited to monitor the thread for thread breakage in conjunction with a looper shuttle. Since the looper can move with respect to the thread monitor, the support surface must be made sufficiently large so that the light rays from the light source strike only the support surface or the thread covering the surface even if the looper continues to move. Thus, other than the scattered light rays reflected at the thread in the direction of the light detector, no light rays reach the light detector, so that the relatively weak signal formed from the scattered light rays in the light detector can be processed by the control circuit without any problem, even in the case of a looper. During such a traverse of the looper, the position of the thread on the support surface changes relatively little. Thus, despite the motion of the looper, the thread always runs in the monitoring range of the thread monitor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figures 1, 2, 3, 6, 7, 8, 9:
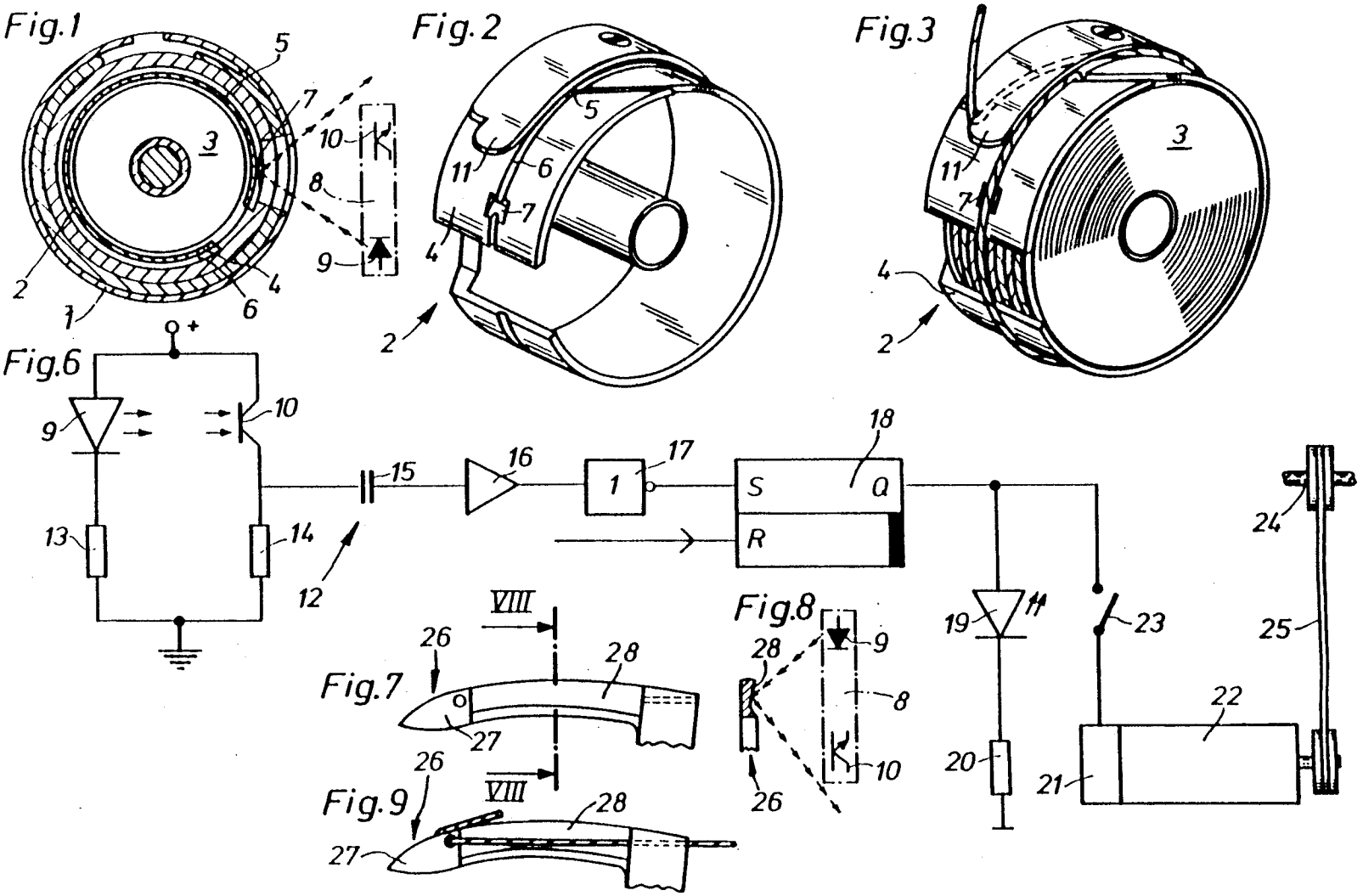
FIG. 1 is a sectional view through a double lock stitch hook constructed in accordance with the invention.
FIG. 2 is a perspective representation of the bobbin case of the double lock stitch hook.
FIG. 3 is a view similar to FIG. 2, but showing the guiding system of the thread.
FIG. 6 is a simplified circuit diagram used to control the thread monitor.
FIG. 7 is a side of the portion of the looper.
FIG. 8 is a sectional view through the looper taken along the line VIII—VIII of FIG. 7; and, FIG. 9 is similar to FIG. 7, but showing the guiding system of the thread.
Figure 4:
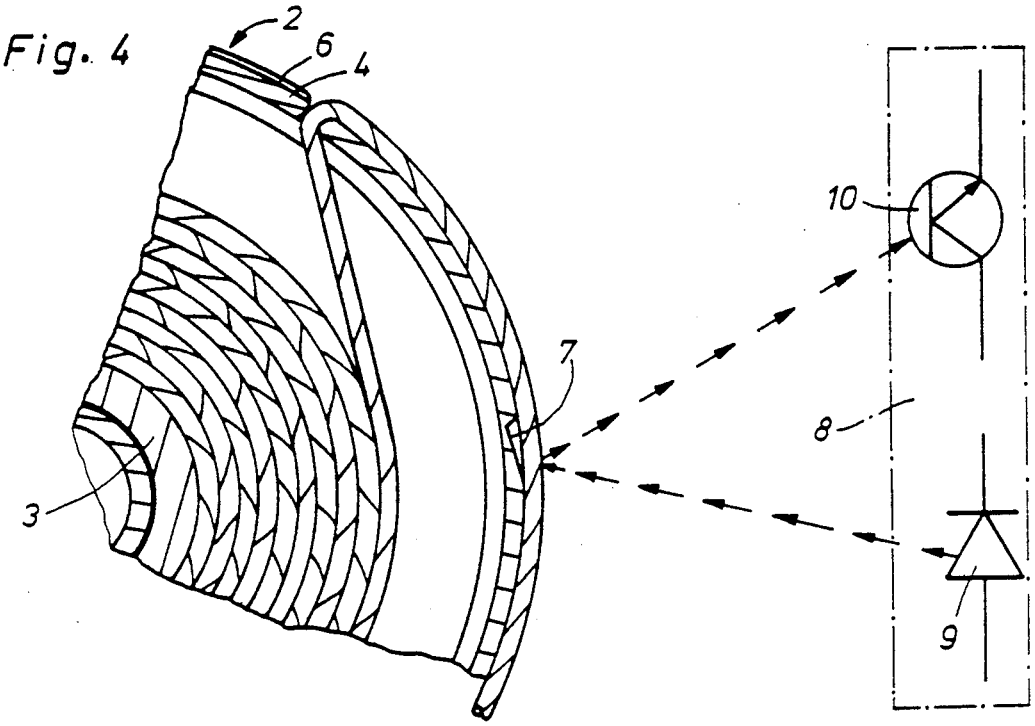
FIGS. 4 and 5 are enlarged sectional views through a circular segment of the bobbin case and bobbin.
Figure 5:
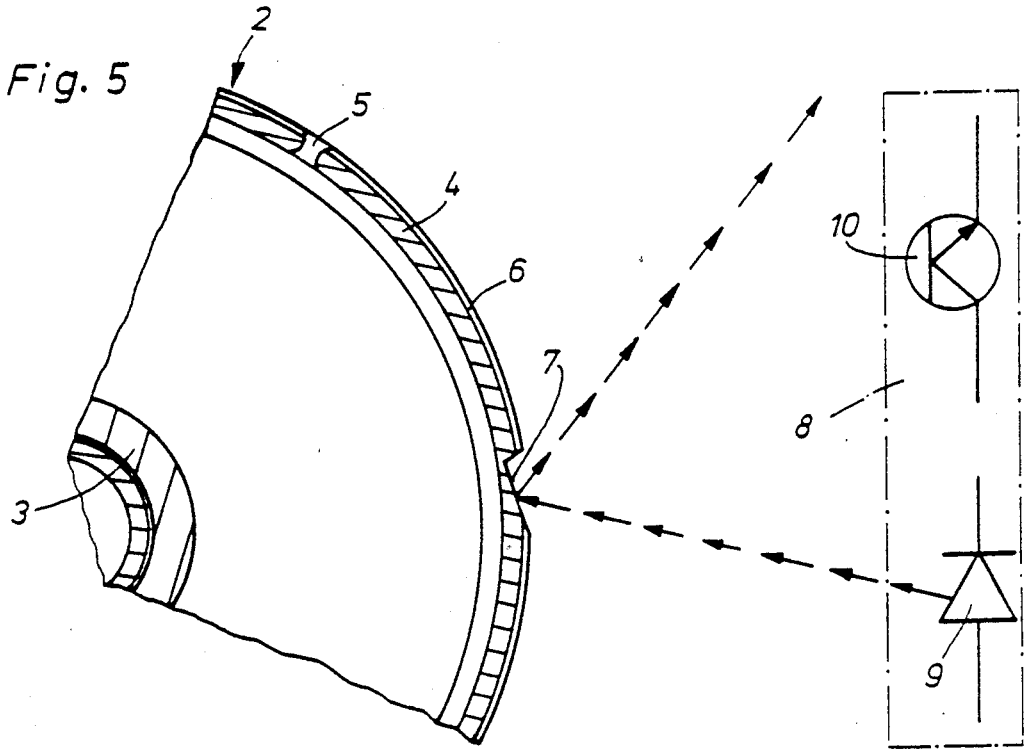
Figure 10:
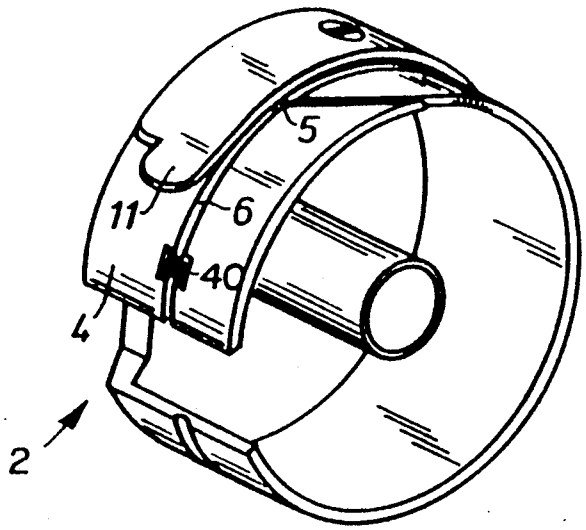

FIG. 1 shows a rotating double lock stitch shuttle or hook 1, which contains a bobbin case 2. The bobbin case 2 has a hollow peg (FIG. 2), which is used to accept a bobbin 3 (FIGS. 1 and 3). The thread is wound on the bobbin 3. An exit opening 5 (FIGS. 1 and 2) for the thread is provided in the annular casing wall 4 of the bobbin case 2. The surface of a groove 6, forms a conducting surface, and it is provided on at least part of the periphery of the bobbin case 2, and it adjoins the exit opening 5. A support surface 7 is advantageously a deflection surface which is recessed into the casing wall 4. The deflection surface 7 is located behind the exit opening 5 in the direction, in which the thread is drawn off. The deflection surface 7 is monitored by a thread monitor 8 (FIGS. 1, 4 and 5), which comprises a light-emitting diode 9 and a photo-detector 10 in the form of a phototransistor. The deflection surface 7 is accommodated in the casing wall 4 at an angle to the photo-detector 10. Furthermore, a spring 11 to tension the thread is mounted on the casing wall 4.

FIG. 6 shows a simplified control circuit 12 with the components that are necessary for the functioning of the electrical control of the thread monitor 8. From the plus pole of a controlled voltage source, the current flows via the light-emitting diode 9 and a resistor 13 to ground. Current likewise flows from the plus pole of the voltage source via the photodetector 10 and a resistor 14 to ground.

A capacitor 15 is connected to the emitter of the photodetector 10. Through an amplifier 16 and an inverter or negation element 17, this capacitor is connected to the setting input S of a flip-flop memory 18. The output Q of the flip-flop memory 18 is connected to a display element 19, which is connected to ground through a resistor 20. A switch 23, connected to the shut-off device 21 of a drive motor 22, is also connected at the output Q. The drive motor 22 drives a main shaft 24 of the sewing machine via a V-belt 25.

The arrangement operates in conjunction with the double lock stitch hook as follows:

After the thread exits from the bobbin case 2, it is guided on the periphery of the bobbin case 2 in at least one thread winding. Here the thread runs in the groove 6 and covers part of the deflection surface 7.

The light rays emitted by the light-emitting diode 9 strike the thread and, if the deflection surface is larger, they also strike the exposed parts of this surface on both sides of the thread. Due to the inclination of the deflection surface 7 relative to the photodetector 10, the light rays striking the deflection surface 7 are reflected in a direction where they cannot be received by the photodetector 10. On the other hand, a portion of the scattered light rays reflected at the thread reaches the photodetector 10.

The photodetector 10 becomes conducting due to the scattered light rays received, and current flows through the resistor 14 to ground. The voltage thus applied to the emitter is conducted via the capacitor 15 and the amplifier 16 to the negation element 17. The capacitor 15 is advantageously used to filter out direct currents caused by daylight and low-frequency alternating current caused by the sewing light.

No voltage is present at the output of the negation element 17 as long as the photodetector 10 is conducting. On the other hand, if the thread has been used up to such an extent that the deflection surface 7 is exposed, light rays no longer reach the photodetector 10. Thus, there is no longer a signal present at the input of the negation element 17. As a result, a signal is emitted at its output, and is conducted to the setting input S of the flip-flop memory 18. Thereupon, the flip-flop memory 18 switches on the display element 19 via its output Q, so as to indicate to the operator the approaching end of the thread. When the switch 23 is closed, the output Q of the flip-flop memory 18 simultaneously activates the shut-off device 21. Depending on the design, this immediately shuts off the drive motor 22 or prevents the drive motor 22 from restarting after the next stoppage process.

When the empty bobbin 3 is replaced by a bobbin filled with thread, an electrical signal is conducted in suitable fashion to the reset input R of the memory 18, so that the memory switches off the display element 19 and, if necessary, releases the drive motor 22.

A chain stitch machine shuttle or looper 26, shown in FIGS. 7 to 9, can also be monitored by the thread monitor 8. For this purpose, the looper 26 has on the side facing the thread monitor 8 a deflection surface 28, which is inclined relative to the photodetector 10. Since the looper 26 is movable relative to the photodetector 10, the deflection surface 28 is constructed sufficiently large, so that the light rays from the light-emitting diode 9 strike the deflection surface 28 in every position of the looper 26, and are reflected at the surface away from the receiving range of the photodetector 10. Thus, only scattered light rays reflected at the thread will reach the photodetector 10 as proof of the trouble-free operation of the thread. During a traverse of the looper 26, the position of the thread changes only little relative to the deflection surface 28. Consequently, the thread always runs in the monitoring range of the thread monitor 8.

If the deflection surface 28 is exposed, for example, as a consequence of a thread breakage, and scattered light rays therefore no longer reach the photodetector 10, a control circuit 12, connected to the photodetector 10, emits a warning signal to indicate a thread breakage. This warning signal activates the display device (19) or the shut-off device 21.

The arrangements described above function equally well if the respective support surface is constructed as a surface, which absorbs light rays. Such a surface is not shown in the drawing. In this way, the light rays are reflected only at the thread, which covers the absorbing surface, and enter the light detector 10. The absorbing surface can be constructed, for example, as a roughened, blackened surface 40.

While specific embodiments of the invention have been shown and described in detail to illustrate the application of the principles of the invention, it will be understood that the invention may be embodied otherwise without departing from such principles.

We claim:

1. A sewing machine for use with a sewing machine shuttle with a thread monitor having a light source and a light detector and with a thread, which is guided in the path of light rays from the light source and is used as a reflection surface, such that the light rays reflected by the thread can be received by the light detector and supplied to a control circuit connected thereto in order to emit a warning signal, characterized in that a support surface, which guides the thread and is covered by the thread, is provided at the shuttle, said support surface having means positioned relative to the light detector so that, when the support surface is not covered by the thread, the light rays incident thereon are not supplied to the light detector.

2. The sewing machine of claim 1, characterized in that the support surface is constructed as a surface which absorbs light rays.

3. The sewing machine of claim 1, characterized in that the support surface includes a deflection surface, at which the incident light rays are reflected into a region located outside of the acceptance region of the light detector.

4. The sewing machine of claim 1, characterized in that the support surface, perpendicular to the draw-off direction of the thread, is larger than the diameter of the thread.

5. The sewing machine of claim 1, with a double-saddle stitch shuttle that has a bobbin case and a bobbin, characterized in that the support surface is disposed at the annular wall of the bobbin case, and can be covered by at least one thread winding that is guided along the periphery of the bobbin case.

6. The sewing machine of claim 1, characterized in that a guide surface to guide the thread is formed in the wall on at least a portion of its periphery.

7. The sewing machine of claim 1, characterized in that the guide surface is designed as a groove, which is incorporated in at least a part of the support surface.

8. The sewing machine of claim 1, with a chain-stitch shuttle, characterized in that the support surface is disposed on that side of the chain-stitch shuttle, which faces the thread monitor, and is dimensioned in such a fashion that the light rays coming from the light source strike the support surface during the entire traverse of the chain-stitch shuttle.

9. A sewing thread monitor device for use with a sewing machine shuttle in which thread is directed over a support surface, comprising means defining a light conditioning area associated with the surface on which the thread is guided, means directing light onto the light conditioning area, guide means directing thread over the said light conditioning area into the light so that the thread intercepts the light, and a control circuit including a light detector for detecting light reflected from the thread and providing a warning signal when the light is not sufficiently reflected from the thread to the light detector.

10. A sewing thread observation device according to claim 9, including a surface over which the thread is engaged which absorbs light rays and defines said light conditioning area.

11. A sewing thread observation device according to claim 10, wherein said support surface is perpendicular to the draw-off direction of the thread and is larger than the diameter of the thread and including a hook having a bobbin case and a bobbin, said surface comprising an annular wall of said bobbin case and at least one thread winding that is guided along the periphery of said bobbin case.

12. A sewing thread observation device according to claim 11, wherein said bobbin case includes at least a portion of the periphery of said case defining said light conditioning area, the guide surface of said case comprising a groove defined in at least a portion of the support surface.

13. A sewing thread observation device according to claim 12, wherein said support surface is disposed on a side of a looper which faces the thread monitor and is dimensioned so that light rays coming from the light source strike the support surface during the entire traverse of the looper stitch shuttle.

14. A method of observing thread from a stitch shuttle having a bobbin case over a surface of which the thread is directed comprising providing a light conditioning area on the surface and including directing light to the light conditioning area so that it illuminates the thread which is fed thereover and providing a warning based on a lack of the interception of the light by the thread, to indicate when the thread is no longer present.

* * * * *